United States Patent [19]

Moronaga et al.

[11] Patent Number: 4,633,598

[45] Date of Patent: Jan. 6, 1987

[54] INSOLE FOR SHOE

[75] Inventors: Yoshiharu Moronaga, Kurume; Junji Izumi, Ohmuta, both of Japan

[73] Assignee: Nippon Rubber Co., Ltd., Tokyo, Japan

[21] Appl. No.: 650,529

[22] Filed: Sep. 14, 1984

[30] Foreign Application Priority Data

Sep. 30, 1983 [JP] Japan ..... 58-153107[U]

[51] Int. Cl.[4] ..... A43B 13/40

[52] U.S. Cl. ..... 36/44

[58] Field of Search ..... 36/44, 43, 76 C, 37, 36/69, 80; 128/595, 614, 615

[56] References Cited

U.S. PATENT DOCUMENTS

| | | | |
|---|---|---|---|
| 3,257,742 | 6/1966 | Feiaberg | 36/44 |
| 3,300,880 | 1/1967 | Campagna | 36/44 X |
| 3,414,988 | 12/1968 | Mattos | 36/44 X |
| 4,054,706 | 10/1977 | Shapiro | 36/44 X |
| 4,167,824 | 9/1979 | Wolpa | 36/44 |
| 4,187,621 | 2/1980 | Cohen | 36/44 |
| 4,338,734 | 7/1982 | Schwartz | 36/44 |
| 4,413,429 | 11/1983 | Power | 36/44 |
| 4,513,518 | 4/1985 | Jalbert et al. | 36/44 |
| 4,586,273 | 5/1986 | Chapnick | 36/44 |

*Primary Examiner*—Werner H. Schroeder
*Assistant Examiner*—T. Graveline
*Attorney, Agent, or Firm*—Fleit, Jacobson, Cohn & Price

[57] ABSTRACT

An insole for use in athletic shoes comprises an upper layer, a lower layer laminated on the upper layer, and a shock-absorptive foamed material layer laminated on the underside of the lower layer at least at the heel portion. The upper layer has a hardness of 30°-50°, and the lower layer has a hardness of 50°-70°. The shock-absorptive foamed material layer has a hardness of 50°-80°.

3 Claims, 2 Drawing Figures

INSOLE FOR SHOE

BACKGROUND OF THE INVENTION

The present invention relates to an insole for use in athletic shoes such as shoes for running, basketball, tennis and soccer and, more particularly, to an insole for use in such athletic shoes wherein stability of the foot and good comfort are also provided during use in such activities.

DESCRIPTION OF THE PRIOR ART

There are generally known insoles for use in such athletic shoes, comprising an elastic foamed material which is laminated on a facing formed of leather or fabric to impart cushioning during running. The human anatomy is such that when a person runs, at each step the rear portion of the heel of the foot makes the initial contact with the ground, followed by the heel proper, the outside edge of the foot adjacent to the arch, the ball of the little toe and the ball of the big toe in that order, and finally the big, second, third, fourth and little toe effect a toe-off motion. This motion of the foot is accompanied by a shift of the person's body weight thereon. It has been known that due to the cushioning of the elastic foamed material layer constituting a part of the prior art insole the foot is unstable, i.e., the shock from contact with the ground causes the foamed material layer to be compressed in the course of the initially contacting motion of the heel to the subsequent contacting motion of the foot. The subsequent rapid recovery of the elasticity allows the foot in the shoe, particularly the heel portion, to roll excessively inward, that is to say, to overpronate. Such overpronation causes trouble in the knee joint.

SUMMARY OF THE INVENTION

It is a general object of the present invention to provide an insole for use in athletic shoes, which overcomes the disadvantages of the prior art.

It is a further object of the present invention to provide an insole for use in athletic shoes, which provides stability of the foot and good comfort during running.

These objects are accomplished by an insole which comprises an upper layer having a hardness of 30°–50° (method of hardness test in accordance with SRIS-0101 (The Society of Rubber Industry, Japan Standard), (12.5°–28° shore A hardness) a lower layer having a hardness of 50°–70°(28°–47° shore A hardness), and a shock-absorptive foamed material layer which has a hardness of 50°–80° (28°–63° shore A hardness) and is laminated on the underside of the lower layer at least at the heel portion.

These and other objects and advantages of the present invention will become apparent from the following detailed description with reference to the accompanying drawings wherein:

FIG. 1 is a perspective view of an insole for use in athletic shoes according to the present invention; and FIG. 1 is a sectional view of the insole taken along line A—A of FIG. 1.

DETAILED DESCRIPTION OF THE INVENTION

Figure 1:
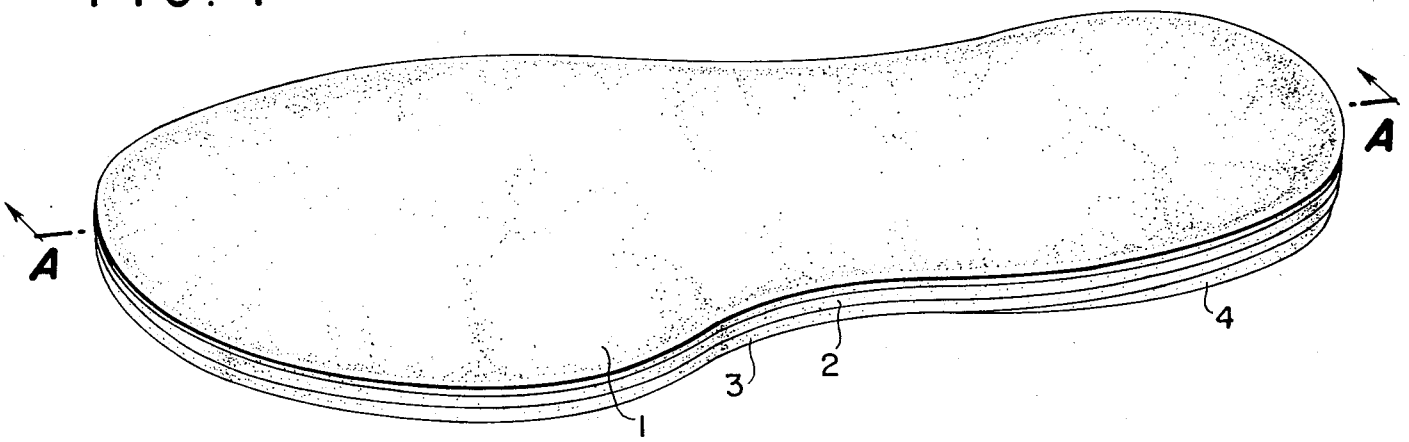
Figure 2:
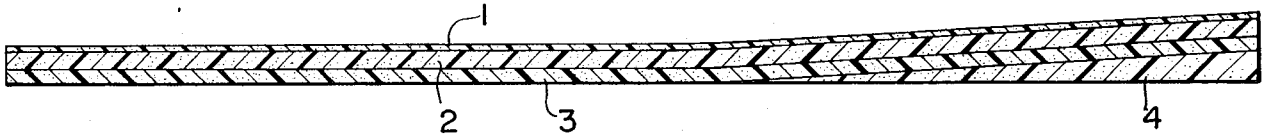

Referring to FIGS. 1 and 2, there is shown an insole for use in athletic shoes, which comprises an upper layer 2, a lower layer 3 laminated on the upper layer 2, and a shock absorptive formed material layer 4 laminated on the underside of the lower layer 3 at least at the heel portion.

In a preferred embodiment, each of the upper layer 2 and the lower layer 3 may be formed, as in the prior art insoles, of a foamed material including rubber foams such as usual natural rubbers and synthetic rubbers, for example, polyurethane rubber; and polyolefinic synthetic resin foams such as polyethylene and copolymer of ethylene with vinyl acetate (EVA).

However, the hardness of the upper layer 2 should be in a range of 30°–50° (method of hardness test in accordance to SRIS (The Society of Rubber Industry, Japan Standard) 0101) (12.5°–28° shore A hardness). If the hardness of the upper layer 2 is less than 30° (12.5° shore A hardness), the upper layer 2 will be too soft, thereby causing the form-maintaining property to be lost. When a person runs with the athletic shoes having the resulting insole therein, the sole of the foot sinks into the upper layer 2, resulting in a substantial reduction in comfort and in stability during running. If the hardness of the upper layer 2 exceeds the upper limit of 50° (28° shore A hardness), the cushioning will be reduced to cause a deterioration in comfort.

The hardness of the lower layer 3 should be in a range of 50°–70° (28°–47° shore A hardness), because a hardness thereof of less than 50° (28° shore A hardness) causes the form-maintaining function relative to the upper layer 2 to be lost. On the other hand, a hardness of the lower layer 3 exceeding 70° leads to a substantial reduction in the cushioning effect of the upper layer 2.

The shock-absorptive foamed material 4 means a viscoelastic material having a self-absorption and a reduced resilience as compared with a perfect elastomer. Such a reduction in resilience is due to the fact that vibrational shear deformation is converted to heat energy when the material is subjected to shock. Examples of such materials which are well known are those produced by foaming and bridging an elastomer material such as rubber, EVA, etc., with a blocking agent; and incompletely bridged urethane foams. The hardness of the foamed material 4 should be limited to a range of 50°–80° (28°–63° shore A hardness). With a hardness of less than 50° (28° shore A hardness), the foamed material 4 will be too soft, being easily compressed and deformed under a small force, resulting in incomplete shock-absorptive properties. On the other hand, a hardness exceeding 80° (63° shore A hardness) will be too hard, decreasing the compressive deformability and resulting in incomplete shock-absorptive properties. Preferably, the hardness of the shock absorptive foamed material 4 may be in a higher range of 70°–80° (28°–63° shore A hardness). When the hardness of the formed material layer 4 is set at 70° (47° shore A hardness) to 80° (28°–63° shore A hardness), the heel portion of the resulting insole gradually increases in hardness downwardly. Thus, the insole cushioning progressively decreases downwardly and progressively increases in its form maintaining properties, resulting in a further increase in comfort and a further increase in stability. Alternatively, the shock-absorptive foamed material layer 4 may be laminated over the entire lower surface of the lower layer 3, if required.

It is to be noted that on the surface of the upper layer 2 there is laminated a facing formed of a soft material such as fabric, leather, etc.

As mentioned above, the insole for use in athletic shoes according to the present invention comprises an upper layer 2 and a lower layer 3 each of which is formed of an elastic foamed material. Between the upper and lower layers there is a difference in hardness within the above ranges. When a person wears the shoes with the insole inserted therein, the upper layer 2 preserves the cushioning, and the lower layer 3 provides a form-maintaining property relative to the upper layer 2, thus providing good comfort and good stability. The shock caused by the contact of heel with the ground during running is absorbed by the shock-absorptive foamed material layer 4 laminated on the lower layer 3 at the underside of the heel portion. Further, since the soft upper layer 2 is laminated over the shock-absorptive foamed material layer 4 with the hard lower layer 3 having a form-maintaining property being interposed therebetween, it cannot be excessively compressed by the shock from the ground, and the cushioning of the upper layer 2 is properly moderated. Thus, good comfort and good stability can be provided for the foot, and overpronation can be prevented, during running.

What is claimed is:

1. An insole for shoes, said insole comprising:

an upper layer formed of an elastic foamed material having a 12.5°–28° shore A hardness;

a lower layer formed of an elastic foamed material having a 28°–47° shore A hardness, said lower layer being laminated on a lower surface of said upper layer; and a shock-absorptive foamed material layer having a 28°–63° shore A hardness, said shock-absorptive foamed material layer being laminated on a lower surface of said lower layer at the heel portion;

the heel portion increases in hardness from said upper layer to said lower layer and increases in hardness from said lower layer to said shock-absorptive foamed material layer.

2. An insole for shoes, said insole comprising:

an upper layer formed of an elastic foamed material having a 12.5°–28° shore A hardness;

a lower layer formed of an elastic foamed material having a 28°–47° shore A hardness, said lower layer being laminated on a lower surface of said upper layer;

a shock-absorptive foamed material layer having a 28°–63° shore A hardness, said shock-absorptive foamed material layer being laminated on the a lower surface of said lower layer only at the heel portion; and the heel portion increases in hardness from said upper layer to said lower layer and increases in hardness from said lower layer to said shock-absorptive foamed material layer.

3. An insole for shoes, said insole comprising:

an upper layer formed of an elastic foamed material having a 12.5°–28° shore A hardness;

a lower layer formed of an elastic foamed material having a 28°–47° shore A hardness, said lower layer being laminated on a lower surface of said upper layer;

a shock-absorptive foamed material layer having a 28°–63° shore A hardness, said shock-absorptive foamed material layer being laminated on the a lower surface of said layer at least at the heel portion; and the heel portion increases in hardness from said upper layer to said lower layer and increases a hardness from said lower layer to said shock-absorptive foamed material layer.

* * * * *